US009896631B2

(12) United States Patent
Gajda et al.

(10) Patent No.: US 9,896,631 B2
(45) Date of Patent: Feb. 20, 2018

(54) METHODS FOR REMOVING IMPURITIES FROM HYDROCARBONS

(71) Applicant: UOP LLC, Des Plaines, IL (US)

(72) Inventors: Gregory J. Gajda, Mount Prospect, IL (US); Bart Dziabala, Hickory Hills, IL (US); Belma Demirel, Clarendon Hills, IL (US); Thomas Pereira, Chicago, IL (US)

(73) Assignee: UOP LLC, Des Plaines, IL (US)

( * ) Notice: Subject to any disclaimer, the term of this patent is extended or adjusted under 35 U.S.C. 154(b) by 224 days.

(21) Appl. No.: 14/566,212

(22) Filed: Dec. 10, 2014

(65) Prior Publication Data

US 2016/0168057 A1 Jun. 16, 2016

(51) Int. Cl.

| | |
|---|---|
| ***C10G 25/02*** | (2006.01) |
| ***C10G 45/32*** | (2006.01) |
| ***C07C 7/12*** | (2006.01) |
| ***C10G 67/06*** | (2006.01) |
| ***C10G 45/34*** | (2006.01) |

(52) U.S. Cl.

CPC ..... *C10G 67/06* (2013.01); *C10G 25/02* (2013.01); *C10G 45/32* (2013.01); *C10G 45/34* (2013.01)

(58) Field of Classification Search

None

See application file for complete search history.

(56) References Cited

U.S. PATENT DOCUMENTS

| | | | | |
|---|---|---|---|---|
| 3,003,002 | A * | 10/1961 | Feinstein | B01J 41/05 568/699 |
| 3,990,844 | A * | 11/1976 | Cormany | B01J 41/05 8/142 |
| 5,692,461 | A * | 12/1997 | Crovato | F01P 11/06 123/41.14 |
| 6,077,984 | A | 6/2000 | Drake | |
| 7,220,879 | B2 | 5/2007 | Bass et al. | |
| 7,288,184 | B2 | 10/2007 | van Nuland et al. | |
| 7,744,828 | B2 | 6/2010 | Schmidt | |
| 8,425,764 | B2 | 4/2013 | Lin | |

(Continued)

FOREIGN PATENT DOCUMENTS

| | | | | |
|---|---|---|---|---|
| FR | WO 03091370 | A1 * | 11/2003 | |
| GB | 820272 | A * | 9/1959 | B01J 47/003 |

(Continued)

OTHER PUBLICATIONS

Story et al., Chemistry of Gum Formation by Cracked Gasoline, Industrial and Engineering Chemistry, vol. 21, No. 11, Nov. 1929, pp. 1079-1084.*

(Continued)

*Primary Examiner* — Philip Louie

(57) ABSTRACT

Methods are provided for producing hydrocarbons. A method for producing hydrocarbons may include a method of removing impurities from a hydrocarbon stream using a strong base resin. The strong base resin absorbs at least a portion of the impurities from the hydrocarbon stream to provide a purified hydrocarbon stream. Further, the method for producing hydrocarbons may include feeding the purified hydrocarbon stream to a reaction zone comprising a catalyst to form a reaction zone effluent stream.

13 Claims, 2 Drawing Sheets

(56) References Cited

U.S. PATENT DOCUMENTS

| | | | | |
|---|---|---|---|---|
| 2003/0225305 | A1* | 12/2003 | Kaminsky | C10G 45/34<br>585/260 |
| 2005/0152819 | A1* | 7/2005 | Schmidt | C07C 2/66<br>422/610 |
| 2006/0037913 | A1* | 2/2006 | Gottlieb | B01J 41/04<br>210/688 |

FOREIGN PATENT DOCUMENTS

| | | | | |
|---|---|---|---|---|
| GB | 1316080 | A * | 5/1973 | C10G 45/08 |
| WO | 2004035712 | A1 | 4/2004 | |

OTHER PUBLICATIONS

Lopez et al., Anion Exchange in Amberlite IRA-400 and Amberlite IRA-410 Ion Exchange Resins, J. Chem. Eng. Data 1992, 37, p. 274-277.*

WO03091370 Description English Machine Translation, Nov. 29, 2017, pp. 1-17.*

Xie, Selective Adsorption of Neutral Nitrogen Compounds from Fuel Using Ion-Exchange Resins, J. Chem. Eng. Data 2010, 55, pp. 4849-4853, 2010 American Chemical Society, Published on Web Sep. 17, 2010.

McKay, Separation and Analyses of Petroleum Residues, Laramie Energy Research Center, Laramie, Wyoming.

* cited by examiner

METHODS FOR REMOVING IMPURITIES FROM HYDROCARBONS

FIELD

The present subject matter relates generally to methods for hydrocarbon production. More specifically, the present subject matter relates to methods for removing impurities from a hydrocarbon stream using a strong base resin.

BACKGROUND

Streams rich in aromatics that also include diolefins are often formed as by-products of hydrocarbon conversion processes. For example, pyrolysis gasoline is often obtained as a by-product from thermal cracking of various hydrocarbons. The pyrolysis gasoline often includes many aromatic compounds, as well as diolefins (hydrocarbons with two sets of double bonds), mono-olefins (hydrocarbons with one double bond), alkanes with no double bonds, and sulfur and nitrogen compounds. Depending on the feed source to the thermal cracker, pyrolysis gasoline may also contain metal contaminants. Pyrolysis gasoline can be used as a source for aromatic compounds, but the diolefins, mono-olefins, sulfur and nitrogen compounds need to be removed before the aromatic compounds can be recovered by various processes, such as solvent extraction.

The pyrolysis gasoline is often treated in a two-step process prior to separating and purifying the aromatic compounds. This application addresses improvements to only the first step of the process. In the first step, diolefins and any alkynes are selectively hydrogenated to form mono-olefins and some paraffins. The first step is operated under moderate conditions in the presence of a selective catalyst such that primarily diolefins are reacted to mono-olefins. At the same time some of the mono-olefins are saturated and very few, if any, aromatic compounds are saturated. In the second step, additional mono-olefins are saturated (hydrogenated) to form alkanes, and the nitrogen and sulfur compounds are removed. The second step is operated in the presence of a catalyst under more severe reaction conditions, that would cause diolefins to polymerize and undesirably result in reactor pressure drop issues, therefore the first step should convert or remove the more reactive diolefins prior to the second step.

As mentioned above, the first step is operated at moderate conditions with a selective catalyst, so diolefins are reacted to mono-olefins, but relatively few mono-olefins are saturated and essentially no aromatic compounds saturated. The diolefins are more reactive than the mono-olefins and aromatic species. The first step is often operated at a reactor inlet temperature of about 50 to about 150° C. with a delta temperature of up to about 20-50° C. across the reaction zone and a maximum outlet temperature of about 200 degrees centigrade (° C.) or less. The second step is often operated at an inlet temperature of about 250 to about 350° C. with about a 30-60° C. delta temperature across the reaction zone and a maximum outlet temperature of about 400° C. The diolefins and mono-olefins are hydrogenated in separate reactors, i.e. the first and second steps are conducted in separate reactors, to limit and control polymerization of the diolefins. Reducing mono-olefin hydrogenation reactions in the first stage limits excessive heat from the exothermic reaction that causes polymerization of diolefins. Over time deposit of heavy polymerate gradually accumulates and deactivates the catalyst, so periodically the catalyst needs to be hot hydrogen stripped or regenerated.

The claimed subject matter focuses on methods for removing impurities from a hydrocarbon stream before the hydrocarbon stream enters the first stage reactor section of the pyrolysis gasoline treatment process. In one example, a guard bed containing a strong base resin may be located upstream from the first stage reaction section. Therefore, the hydrocarbon stream passes through the guard bed and contacts the strong base resin. The strong base resin absorbs some impurities from the hydrocarbon stream, therefore sending a more purified hydrocarbon stream to the reaction zone.

Accordingly, it is desirable to develop methods for producing hydrocarbons. In addition, it is desirable to develop methods for removing impurities from the hydrocarbon stream before the hydrocarbon stream enters the reaction zone to substantially reduce the deactivation rates of the reaction zone catalyst. Removing impurities from the hydrocarbon stream may also aid in restoring the activity of the reaction zone catalyst without a regeneration step. Furthermore, other desirable features and characteristics of the methods described herein will become apparent from the subsequent detailed description and the appended claims, taken in conjunction with the accompanying drawings and this background.

SUMMARY

Methods for producing hydrocarbons are provided. By one aspect, a method for producing hydrocarbons may include methods for removing impurities from a hydrocarbon stream including contacting the hydrocarbon stream with at least one strong base resin that absorbs at least a portion of the impurities from the hydrocarbon stream to provide a purified hydrocarbon stream. Further, the method for producing hydrocarbons may include feeding the purified hydrocarbon stream to a reaction zone comprising a catalyst to form a reaction zone effluent stream.

Methods for removing impurities from a hydrocarbon stream before the hydrocarbon stream enters the first stage reactor section of the pyrolysis gasoline treatment process are provided. In one example, a guard bed containing a strong base resin may be located upstream from the first stage reaction section. Therefore, the hydrocarbon stream passes through the guard bed and contacts the strong base resin. The strong base resin absorbs some impurities from the hydrocarbon stream, therefore sending a more purified hydrocarbon stream to the first stage reaction zone.

Additional objects, advantages and features will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

Definitions

As used herein, the term "stream", "feed", "product", "part" or "portion" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated $C_1$, $C_2$, $C_3$, Cn where "n" represents the number of carbon atoms in the one or more hydrocarbon molecules or the abbreviation may be used as an adjective for, e.g., non-aromatics or compounds. Similarly, aromatic compounds may be abbreviated $A_6$, $A_7$, $A_8$, An where "n" represents the number of carbon atoms in the one or more aromatic molecules. Furthermore, a superscript "+" or "−" may be used with an abbreviated one or more hydrocarbons notation, e.g., $C_{3+}$ or $C_{3-}$, which is inclusive of the abbreviated one or more hydrocarbons. As an example, the abbreviation "$C_{3+}$" means one or more hydrocarbon molecules of three or more carbon atoms.

As used herein, the term "zone" can refer to an area including one or more equipment items and/or one or more sub-zones. Equipment items can include, but are not limited to, one or more reactors or reactor vessels, separation vessels, distillation towers, heaters, exchangers, pipes, pumps, compressors, and controllers. Additionally, an equipment item, such as a reactor, dryer, or vessel, can further include one or more zones or sub-zones.

As used herein, the term "rich" can mean an amount of at least generally 50%, and preferably 70%, by mole, of a compound or class of compounds in a stream.

As used herein, the term "substantially" can mean an amount of at least generally 80%, preferably 90%, and optimally 99%, by mole or weight, of a compound or class of compounds in a stream.

As used herein, the term N-oxide refers to the general class of organic nitrogen containing compounds that have reacted with $O_2$. For example, an oxidized amine would be an amine oxide, an oxidized imine would be an imine oxide and an oxidized aniline would be an aniline oxide. All would have a N—O bond in the oxidized form.

BRIEF DESCRIPTION OF THE DRAWINGS

The drawing figures depict one or more implementations in accord with the present concepts, by way of example only, not by way of limitations.

DETAILED DESCRIPTION

The following detailed description is merely exemplary in nature and is not intended to limit the application and uses of the embodiment described. Furthermore, there is no intention to be bound by any theory presented in the preceding background or the following detailed description.

The various embodiments described herein relate to methods for producing hydrocarbons, including methods for removing impurities. By one aspect, diolefins in an aromatic rich feed stream are reacted with hydrogen in the presence of a catalyst to produce mono-olefins in a reactor effluent stream. Some of the reactor effluent stream is or can be recycled while the rest is fractionated in a fractionation zone to produce a $C_{5-}$ stream, a $C_6$-$C_8$ stream, and a $C_{9+}$ stream, where the letter "C" represents carbon, and the following number represents the number of carbon atoms present in the molecule.

Figure 1:
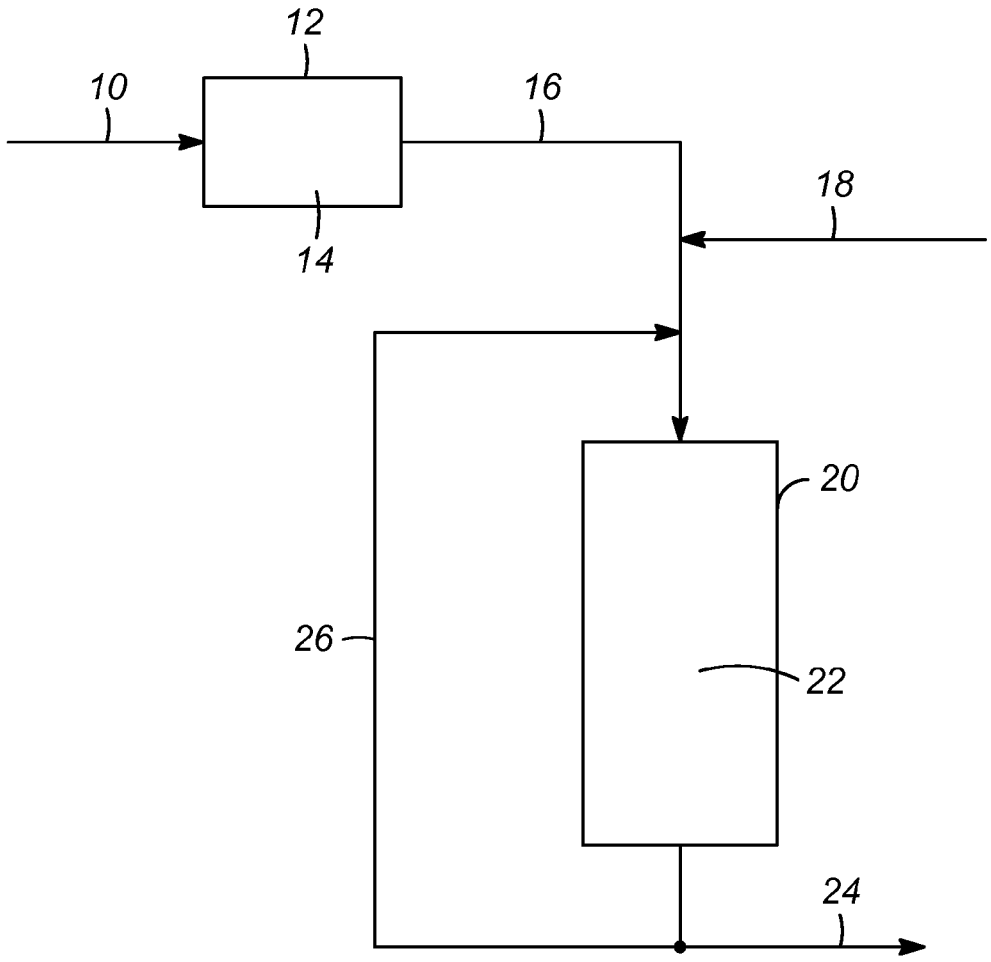
FIG. 1 is a schematic diagram of a method for removing impurities from a hydrocarbon stream using a guard bed containing a strong base resin in accordance with various embodiments.

In one approach, and with reference to FIG. 1, an aromatic rich feed stream 10 is fed into a guard bed 12. The first aromatic rich feed stream 10 includes $C_4$-$C_{10}$ hydrocarbons, such that about 20 percent or more by one approach, about 50 percent or more by another approach, and about 90 mass percent or more by yet another approach of the first aromatic rich feed stream 10 is hydrocarbons with 4 to 10 carbon atoms. The first aromatic rich feed stream 10 includes about 20 mass percent or more aromatic compounds, so it is rich in aromatic compounds. The first aromatic rich feed stream 10 may include a pyrolysis gasoline produced by steam cracking variety of feed types including light alkanes, naphtha, distillates, and gas oils. The first aromatic rich feed stream 10 may also include other or additional sources, such as a coke oven light oil, steam cracker compressor wash oil, etc.

The first aromatic rich feed stream 10 includes aromatic compounds, and often includes about 30 to about 90 mass percent aromatic compounds. The first aromatic rich feed stream 10 also includes at least one of diolefins and mono-olefins, saturates (hydrocarbons without double or triple bonds between adjacent carbon atoms) sulfur and/or nitrogen compounds, and may include some alkynes, and metal contaminants. The components of the aromatic rich feed stream may vary widely. For example, where the aromatics rich feed stream 10 include a pyrolysis gasoline stream, the feedstock and operating conditions in a steam cracker that produces pyrolysis gasoline varies widely, so the components of the pyrolysis gasoline stream vary widely. As an example, one pyrolysis gasoline aromatic rich feed stream 10 included about 17 mass percent $C_{5-}$ compounds, about 79 mass percent $C_6$-$C_8$ compounds, and about 4 mass percent $C_{9+}$ compounds, where about 68 mass percent of the entire stream was aromatic compounds, 16 mass percent was diolefins, about 12 mass percent was mono-olefins, and about 4 mass percent was saturates. In this example the feed contained about 180 wppm sulfur and about 1 wppm nitrogen. As mentioned above, the concentration of the various components in the first aromatic rich feed stream 10 can vary significantly from the example described above.

Another advantage of the methods for hydrocarbon production is that using a strong base resin as a guard bed may help maintain stability and activity. A pyrolysis gasoline rich aromatic stream may form impurities when it contacts air. Oxygen contamination from air can occur in a number of ways. For example if the pyrolysis gasoline or other feed is handled or transported there is the possibility that some air will get into a normally closed system. At times the feed is not stored under a nitrogen or other inert gas blanket. In some situations a vacuum fractionation column is installed upstream of the pyrolysis gasoline hydrotreating unit in order to remove a small fraction of the feed that is expected to have increased concentration of gums. During the vacuum fractionation there is some air ingress that can occur into the pyrolysis gasoline feed. For example, oxygen from air can form N-oxides and peroxides, which may act as a temporary poison to the catalyst in the downstream reaction zone. Pyrolysis gasoline should not encounter oxygen in a commercial unit, but it does happen inadvertently. Commercially anti oxidants or oxygen scavengers may be added to the pyrolysis gasoline feed to handle any inadvertent air exposure. Introducing a strong base resin guardbed may solve this problem by removing the small amounts of N-oxide or peroxide formed by reaction of any air that has inadvertently contacted the feed with the nitrogen-based inhibitors or some of the nitrogen compounds found in the feed or easily peroxidizable dienes. In one example, a guard bed containing a strong base resin may be located upstream from the first stage reaction section. Therefore, the hydrocarbon stream passes through the guard bed and contacts the strong base resin. The strong base resin contains a positively charged quaternary ammonium group along with an exchangeable hydroxide anion attached to a polymer structure and absorbs the N-oxides and peroxides. Therefore, the strong base resin absorbs some impurities from the hydrocarbon stream, therefore sending a more purified hydrocarbon stream to the reaction zone. The strong base resin however, does not adsorb or convert or saturate any diolefins or olefins.

By one aspect, as illustrated in the FIG. 1, a hydrocarbon feed stream 10 is fed to the adsorption zone 12 and is contacted with an adsorbent 14 capable of removing oxidized anionic species such as peroxides or N-oxides. Peroxides and N-oxides are slightly acidic and readily exchange with the hydroxyl anions to form adsorbed peroxide or N-oxide anions and water as a byproduct. The purified hydrocarbon stream 16 leaves the adsorption zone and is further processed in a reaction zone 20. Low temperatures are preferably used in the adsorption zone as the adsorbents have only moderate thermal stability, with temperatures ranging from about 20 to about 70° C. In an exemplary embodiment, the inlet temperature is about 40 to about 60° C., and the outlet temperature is essentially the same as there is little heat of adsorption due to the ion-exchange nature of the reaction. The adsorption zone pressure can vary, such as from about 2,000 kilopascals (kPa) to about 7,000 kPa in one example, from about 2000 to 6000 kPa in another example, and from about 3000 to 4000 kPa in yet another example. In general, the pressure is chosen so that the adsorption takes place in the liquid phase and is suitable for directly passing the effluent of the adsorption zone into the reaction zone without additional pressure increase. The liquid hourly space velocity (LHSV) of the feed stream 10 can also vary over a wide range. Typically, the LHSV will be in the range of about 0.1 to about 10 liters of the first aromatic rich feed stream 10 per liter of adsorbent per hour. The LHSV is ultimately set by the concentration of impurities to be removed from the feed steam 10, the capacity of the adsorbent and the desired interval between switching to a swing bed of adsorbent or regenerating the used adsorbent.

By one aspect, a strong base resin is used for the guard bed. More specifically, a type I anion exchange resin is used to adsorb the impurities. In one example, the strong base resin includes Amberlyst® A-26, a quaternary ammonium type ion exchange resin having a macroreticular structure that is commercially available from Sigma-Aldrich. However, it is contemplated that other strong base resins may also be used. For example, other examples of strong base resins include styrene-divinylbenzene copolymers with quaternary ammonium groups and acrylic acid-divinylbenzene copolymers with quaternary ammonium groups. Styrene-divinylbenzene copolymers may be used either in the hydroxide form or they may be converted to the hydroxide form by exchange with sodium hydroxide solution. Some examples of styrene-divinylbenzene copolymers that may be used include IMAC™ HP555, Amberjet™ 9000 OH, Amberjet™ 4200 OH, Dowex® Monosphere™ 550A (OH), Dowex® 22 OH, Dowex® Marathon™ A (OH), Dowex® MSA-1, Purolite® A500, Duolite A-161, Ionac A641, Amberlite® IRA900, Lewatit® ASB-1 P, and Lewatit® Monoplus M 500. Acrylic acid-divinylbenzene copolymers with quaternary ammonium groups may be used either in the hydroxide form or they may be converted to the hydroxide form by exchange with sodium hydroxide solution. Some examples of acrylic acid-divinylbenzene copolymers that may be used include Lewatit® A 8071 and Aldex CRA. It is contemplated that other strong based resins having quaternary ammonium groups may be used as well.

The strong base resin may also be regenerated using any standard regeneration method. For example, the strong base resin may be regenerated by using a back flush with sodium hydroxide solution.

By one aspect, as illustrated in FIG. 1 a hydrogen supply stream 18 is fed to the reaction zone 20 and provides hydrogen gas. The reduced impurity aromatic rich feed stream 16 contacts the catalyst 22 in the reaction zone 20 in the presence of hydrogen, where at least a portion of the diolefins are catalytically hydrogenated to form mono-olefins. At least a portion of alkynes in the reduced impurity feed stream 16 are also reacted to form mono-olefins, and some olefins may be reacted to form saturates. Aromatic compounds include more than 2 sets of double bonds, but aromatic compounds are more stable than diolefins so relatively few to none of the aromatic compounds in the reduced impurity aromatic rich feed stream 16 are hydrogenated in each reactor. Low temperatures are preferably used in the reactors, which produces mild reaction conditions, with temperatures ranging from about 40 to about 200° C. In an exemplary embodiment, the inlet temperature is about 40 to about 60° C., and the outlet temperature is about 120 to about 150° C. The reaction pressure can vary, such as from about 2,000 kilopascals (kPa) to about 7,000 kPa in one example, from about 2000 to 6000 kPa in another example, and from about 3000 to 4000 kPa in yet another example. The liquid hourly space velocity (LHSV) of the first reduced impurity aromatic rich feed stream 16 can also vary over a wide range. Typically, the LHSV will be in the range of about 0.5 to about 30 liters of the first aromatic rich feed stream 16 per liter of catalyst per hour. However, the LHSV may be in the range of about 1.0 to about 10 liters of the first reduced impurity aromatic rich feed stream 16 per liter of catalyst per hour. The temperature, pressure, hydrogen addition rates, and LHSV variables are controlled to avoid significant hydrogenation of mono-olefins.

The first reaction zone 20 is configured to contain a first catalyst 22. An advantage of the methods for hydrocarbon production presented herein is that impurities may be removed from the hydrocarbon stream prior to entering the reaction zone therefore minimizing the deactivation of the catalyst downstream. Here, the catalysts selectively catalyze hydrogenation of diolefins and alkynes to produce mono-olefins and some olefins to saturates, but have little catalytic activity for hydrogenation of aromatic compounds at the reaction conditions in the reactors. Another advantage of the methods for hydrocarbon production is that the method of removing the impurities substantially reduces the deactivation rates and can restore activity without a regeneration step. Therefore, the entire process does not have to shut down as often for hot hydrogen strip or regeneration.

In an exemplary embodiment, the catalysts include a metal from group 10 of the periodic table of elements (nickel, palladium, and platinum), and a support. The group 10 metal can be in one of several forms, such as in the metal form, oxide form, or sulfide form. In some embodiments, the catalysts also include one or more other metals or metal compounds, such as a metal or metal compound from groups 8 and/or 9 and/or 11 of the periodic table of elements (iron, ruthenium, osmium, cobalt, rhodium, iridium, copper, silver, and gold), and/or one or more alkali metals which may include an acidity modifier. Any of the metals may be sulfided, where the metal is reacted with sulfur to form a metal sulfide.

The support can be any of a wide variety of materials, such as aluminum oxide, silicon oxide, titanium oxide, zirconium oxide, aluminum phosphate, scandium oxide, yttrium oxide, magnesium oxide, silica, aluminosilicates (clays, zeolites), activated carbon, and combinations thereof. In some embodiments, the support includes one or more aluminum oxide (alumina), such as alpha-alumina, theta-alumina, gamma-alumina, boehmite, diaspore, bayerite and/or pseudoboehmite. The support is alkali treated in some embodiments to remove acidity. Particles of the catalysts can have many shapes, including but not limited to spherical, cylindrical, granular, and trilobal, and the catalyst particle size can vary widely as well, such as from an average size of about 0.1 to about 100 millimeters (mm), as a length or diameter.

In the embodiment illustrated in FIG. 1, a reactor effluent stream 24 exits the reaction zone 20, where the reaction zone effluent stream 24 primarily includes mono-olefins, alkanes, and aromatic compounds. There are a reduced amount of diolefins and alkynes in the reaction zone effluent stream 24, such as less than about 1 mass percent, but the reaction conditions may be adjusted to achieve a desired conversion level. As shown in FIG. 1, a portion of the reaction zone effluent stream 26 may be recycled back to the reduced impurity hydrocarbon stream 16 where it may enter the reaction zone 20, along with the reduced impurity aromatic rich feed stream 16 and the hydrogen supply stream 18. The product stream 24 may be fractionated in a fractionation zone to produce various fractions for further processing or use, so the reactors may be coupled to a fractionation zone.

Figure 2:
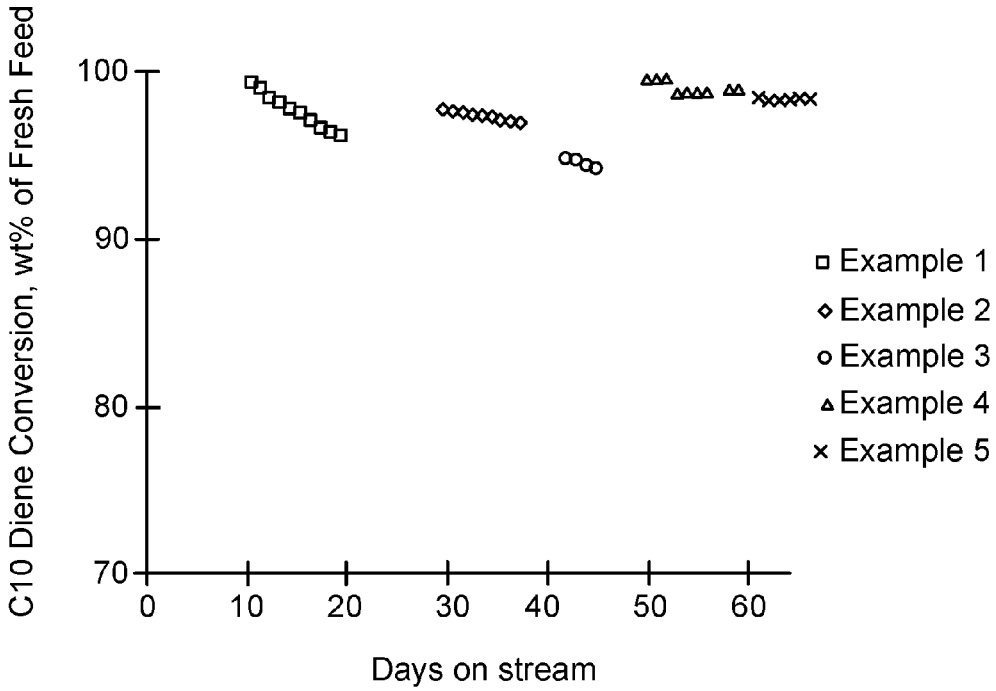
FIG. 2 is a graph showing the effect of contacting the hydrocarbon stream with the strong base resin on catalyst activity.

The catalyst activity measured by the conversion of diolefins is summarized in FIG. 2. The tests were conducted on a single stage once-through hydrotreating pilot plant. The pressure was 500 psig, the LHSV was 2 (pyrolysis gasoline) or 5.93 (Overall), and the reactor temperature was 88° C.-93° C. The feed was a pyrolysis gasoline collected from an ethane based commercial steam cracker diluted down with toluene to simulate recycle and control the exothermic reaction (28% pyrolysis gasoline, 72% toluene). The hydrogen to pyrolysis gasoline diene molar ratio was 2-3:1. GC analysis determined the diolefins, olefin and paraffin content in the feed and product.

Example 1 used the phenylenediamine inhibited feed. The phenylenediamine inhibited feed contained more organic nitrogen, so more N-oxides were formed when the feed came into contact with air. Although steps were taken to minimize exposure to air the pilot plant feed came into contact with air during sampling from commercial unit, handling, and preparation. No guardbed was used in this example. Example 1 had the highest deactivation rate.

Examples 2-5 used the butylated hydroxyltoluene (BHT) inhibited feed. Examples 2 and 3 did not use the A-26 guardbed. A power outage occurred between Examples 2 and 3. The power outage caused a loss of activity for the catalyst, and poorer stability. Example 4 used the BHT inhibited feed with the A-26 guardbed. The catalyst's activity and stability improved during Example 5. Example 6 used treated toluene in the blend. The treater removes the $O_2$ dissolved in the toluene. Without the $O_2$ from the toluene, less N-oxides or peroxides will form in the feed. The remaining N-oxides and peroxides were removed in the A-26 drier. Example 6 had the best stability and activity.

It should be noted that various changes and modifications to the presently preferred embodiments described herein will be apparent to those skilled in the art. Such changes and modifications may be made without departing from the spirit and scope of the present subject matter and without diminishing its attendant advantages.

Specific Embodiments

While the following is described in conjunction with specific embodiments, it will be understood that this description is intended to illustrate and not limit the scope of the preceding description and the appended claims.

A first embodiment of the invention is a method for removing impurities from a hydrocarbon stream comprising contacting the hydrocarbon stream with at least one strong base resin that absorbs at least a portion of the impurities from the hydrocarbon stream to provide a purified hydrocarbon stream. An embodiment of the invention is one, any or all of prior embodiments in this paragraph up through the first embodiment in this paragraph, further comprising feeding the purified hydrocarbon stream to a reaction zone comprising a catalyst to form a reaction zone effluent stream. An embodiment of the invention is one, any or all of prior embodiments in this paragraph up through the first embodiment in this paragraph, wherein the hydrocarbon stream comprises $C_4$-$C_{10}$ hydrocarbons. An embodiment of the invention is one, any or all of prior embodiments in this paragraph up through the first embodiment in this paragraph, wherein the hydrocarbon stream comprises pyrolysis gasoline. An embodiment of the invention is one, any or all of prior embodiments in this paragraph up through the first embodiment in this paragraph, wherein the strong base resin is a type I anion exchange resin. An embodiment of the invention is one, any or all of prior embodiments in this paragraph up through the first embodiment in this paragraph, wherein the impurities are selected from the group consisting of N-oxides and peroxides. An embodiment of the invention is one, any or all of prior embodiments in this paragraph up through the first embodiment in this paragraph, wherein the strong base resin converts less than 1% of di-olefins and olefins. An embodiment of the invention is one, any or all of prior embodiments in this paragraph up through the first embodiment in this paragraph, further comprising hydroprocessing the purified hydrocarbon stream in the reaction zone to form the reaction zone effluent stream having a reduced di-olefin content relative to the purified hydrocarbon stream. An embodiment of the invention is one, any or all of prior embodiments in this paragraph up through the first embodiment in this paragraph, further comprising saturating di-olefins in the purified hydrocarbon stream in the reaction zone under di-olefin saturation conditions to convert at least a portion of the di-olefins in the hydrocarbon stream to form the reaction zone effluent stream. An embodiment of the invention is one, any or all of prior embodiments in this paragraph up through the first embodiment in this paragraph wherein the reaction zone comprises multiple reactors. An embodiment of the invention is one, any or all of prior embodiments in this paragraph up through the first embodiment in this paragraph wherein the catalyst comprises a metal from group 10 of the periodic table, and wherein the catalyst further comprises a support selected from one or more of aluminum oxide, silicon oxide, titanium oxide, and zirconium oxide. An embodiment of the invention is one, any or all of prior embodiments in this paragraph up through the first embodiment in this paragraph wherein the reaction zone operates at a temperature from about 30° C. (86° F.) to about 140° C. (284° F.). An embodiment of the invention is one, any or all of prior embodiments in this paragraph up through the first embodiment in this paragraph wherein the reaction zone operates at a pressure from about 1379 kPa (200 psig) to about 6895 kPa (1000 psig). An embodiment of the invention is one, any or all of prior embodiments in this paragraph up through the first embodiment in this paragraph, wherein the strong base resin may be regenerated. An embodiment of the invention is one, any or all of prior embodiments in this paragraph up through the first embodiment in this paragraph, further comprising performing an additional purification process to remove at least another portion of the impurities from the hydrocarbon stream.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A method for removing impurities from a hydrocarbon stream comprising:

contacting the hydrocarbon stream with at least one strong base anion exchange resin to adsorb at least a portion of the impurities from the hydrocarbon stream and produce a purified hydrocarbon stream, wherein the impurities are selected from the group consisting of N-oxides and peroxides, and the hydrocarbon stream comprises di-olefins and olefins.

2. The method of claim 1, further comprising feeding the purified hydrocarbon stream to a reaction zone comprising a catalyst to form a reaction zone effluent stream.

3. The method of claim 1, wherein the hydrocarbon stream comprises pyrolysis gasoline.

4. The method of claim 1, wherein the strong base anion exchange resin is a type I anion exchange resin.

5. The method of claim 1, wherein the hydrocarbon stream comprises di-olefins and olefins, and the strong base anion exchange resin converts less than 1 wt % of the di-olefins and olefins.

6. The method of claim 2, further comprising hydroprocessing the purified hydrocarbon stream in the reaction zone to form the reaction zone effluent stream, wherein the reaction zone effluent has a reduced di-olefin content relative to the purified hydrocarbon stream.

7. The method of claim 2, further comprising saturating di-olefins in the purified hydrocarbon stream in the reaction zone under di-olefin saturation conditions to convert at least a portion of the di-olefins in the purified hydrocarbon stream to form the reaction zone effluent stream.

8. The method of claim 2, wherein the reaction zone comprises multiple reactors.

9. The method of claim 2, wherein the catalyst comprises a metal from group 10 of the periodic table, and wherein the catalyst further comprises a support selected from one or more of aluminum oxide, silicon oxide, titanium oxide, and zirconium oxide.

10. The method of claim 2, wherein the reaction zone operates at a temperature from about 30° C. (86° F.) to about 140° C. (284° F.).

11. The method of claim 2, wherein the reaction zone operates at a pressure from about 1379 kPa (200 psig) to about 6895 kPa (1000 psig).

12. The method of claim 1, wherein the strong base anion exchange resin may be regenerated.

13. The method of claim 2, further comprising performing an additional purification process to remove at least another portion of the impurities from the purified hydrocarbon stream.

* * * * *